United States Patent [19]

Kuna et al.

[11] Patent Number: 4,467,557

[45] Date of Patent: Aug. 28, 1984

[54] SHIFTABLE DRIVE SELF-PROPELLED TOY VEHICLE

[75] Inventors: Wayne A. Kuna, Oak Park; John R. Wildman, North Riverside, both of Ill.

[73] Assignee: Marvin Glass & Associates, Chicago, Ill.

[21] Appl. No.: 447,434

[22] Filed: Dec. 6, 1982

[51] Int. Cl.[3] ..... A63H 17/00

[52] U.S. Cl. ..... 446/463

[58] Field of Search ..... 46/202, 206, 209, 210, 46/212, 251, 253

[56] References Cited

U.S. PATENT DOCUMENTS

| | | | |
|---|---|---|---|
| 2,778,158 | 1/1957 | Ernst | 46/206 |
| 3,540,151 | 11/1970 | Ishida | 46/202 |
| 3,810,515 | 5/1974 | Ingro | 46/251 X |
| 3,849,931 | 11/1974 | Gulley, Jr. | 46/210 X |
| 4,051,783 | 10/1977 | Caliri | 46/212 X |
| 4,135,328 | 1/1979 | Yamasaki | 46/209 X |
| 4,380,135 | 4/1983 | Wildman et al. | 46/251 X |

*Primary Examiner*—Robert A. Hafer
*Assistant Examiner*—William H. Honaker
*Attorney, Agent, or Firm*—John S. Pacocha

[57] ABSTRACT

An electric motor driven toy wheeled vehicle is provided with a projecting shift lever movable through an "H" pattern for selectively shifting the vehicle into any one of neutral, two-wheel high speed forward drive, two-wheel high speed reverse drive, four-wheel low speed forward drive, or four-wheel low speed reverse drive. The front and rear axles with their respective wheels and drive gears are journaled for rotation in a chassis which also carries a gear box for lateral axial movement. A mount for the shift lever and motor is supported by the gear box for movement in the longitudinal direction of the chassis transverse to the axial direction. The gear box also carries a high speed two-wheel drive gear train continuously connected to the motor and which can be engaged by movement to one side to drive the rear wheels and a second low speed four-wheel drive gear train also continuously connected to the motor that can be engaged by movement to the other side to drive both the front and rear wheels. A switch with its movable element carried by the mount changes the polarity of the voltage from a DC power source to effect reversal of the motor as well as breaking the electrical connection in the neutral position.

20 Claims, 10 Drawing Figures

SHIFTABLE DRIVE SELF-PROPELLED TOY VEHICLE

BACKGROUND OF THE INVENTION

1. Field of the Invention

This invention relates generally to motor driven toy wheeled vehicles and more particularly to the drive assembly.

2. Background Art

Particularly as four-wheel drive vehicles have become more popular in real-life recreational vehicles, toy vehicles have been developed with four-wheel drive capability. Prior U.S. Pat. Nos. 4,283,879 and 4,306,375 show toy four-wheel drive vehicles driven by inertia and electric motors respectively. Such toys which only have one speed forward four-wheel drive provide entertaining and exciting play for a child in the form of having the vehicle climb steep grades, obstacles and rough terrain. However, many children appreciate that the real-life four-wheel drive vehicles can be shifted out of the low speed four-wheel drive and into a higher speed two-wheel drive and back again as well as into forward and reverse.

SUMMARY OF THE INVENTION

The present invention is concerned with providing a motor driven toy vehicle which a child can easily shift between two-wheel and four-wheel drive as well as high and low speed plus neutral, forward and reverse. These and other objects and advantages of the invention are achieved by providing an electric motor driven toy vehicle with an elongated chassis that carries the front and rear axle wheel and drive gear assemblies as well as a gear box which is shiftable along the axles relative to the chassis. The gear box holds a high speed two-wheel drive gear train, a low speed four-wheel drive gear train, a motor connected to both of the gear trains and a switch for changing the polarity of the voltage of the DC power source for the motor to effect reversal of the motor as well as to cut off the power. Both the motor and the switch are secured to a mount that is supported by the gear box for movement relative to the gear box in the elongated direction of the chassis. A shift lever connected to the mount and projecting outside of the vehicle for manipulation through an "H" shift pattern opening in the vehicle body can selectively move the mount back and forth for forward, neutral or reverse and laterally shift the gear box for the low speed four-wheel drive, neutral, or the high speed two-wheel drive.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
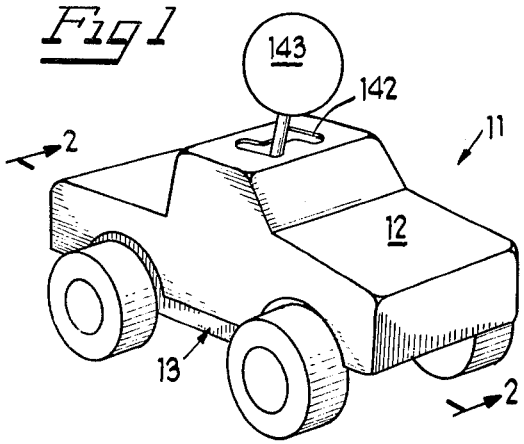
FIG. 1 is a perspective view of a toy vehicle embodying the present invention in reverse low four-wheel drive.
Figure 3:
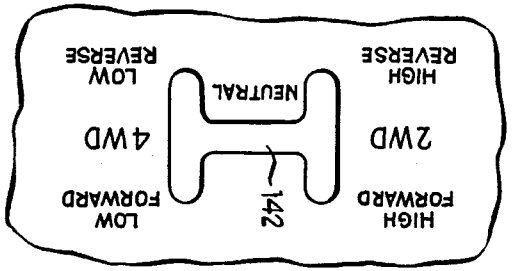
FIG. 3 is a partial top plan view of the shift opening and pattern.
Figure 2:
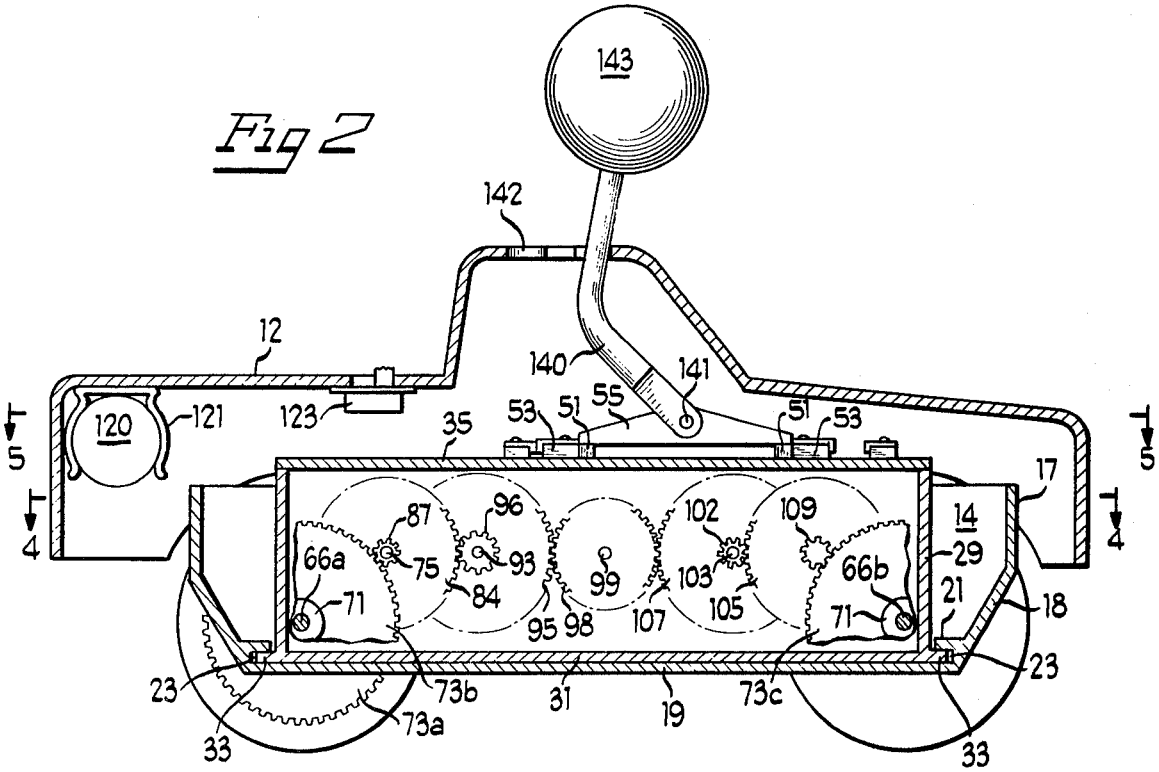
FIG. 2 is an enlarged cross-sectional view taken substantially along line 2—2 of FIG. 1 with the vehicle in forward low four-wheel drive.

Referring now to the drawings in which like parts are designated by like reference characters throughout the several views, there is shown in FIG. 1 a motor driven toy wheeled vehicle 11 having a body 12 of a desired style. The body 12 is attached to a chassis 13 by integrally formed projection and detent means or other suitable fastening means.

Chassis 13 is an elongated, substantially rectangular, box-shaped, one-piece, plastic molded part having side walls 14 and 15, end walls 17 with inwardly sloping lower portions 18, and a floor 19. Ledges 21 are spaced from the floor 19 and project inwardly from each of the end wall lower portions forming a transverse slot 23 extending across the entire width of each end wall 17 from side wall 14 to side wall 15.

Another one-piece plastic molded, elongated, substantially rectangular, part comprises the gear box 25 which has integral side walls 26 and 27, intermediate bearing wall 28, end walls 29, and a floor 31. The ends 33 of the floor 31 project out beyond each of the end walls 29 a distance slightly less than the depth of the slots 23 in the chassis 13. In addition, the thickness or heighth of the floor 31 is slightly less than the heighth of the slot 23. The overall length of the gear box from the outside of one end wall 29 to the outside of the other end wall is slightly less than the dimension between the inward projecting ends of each of the chassis ledges 21. However, the overall width of the gear box 25 is substantially less than the inside width of the chassis 13. Thus it will be appreciated that when the gear box 25 is inserted in the chassis 13, it is substantially secured against front-to-back movement as well as against vertical extraction but may be shifted from side-to-side within the chassis. A cover 35 with a substantially rectangular opening 37, elongated in the same direction as the gear box 25 and the chassis 13, is provided for the gear box. The cover may be secured to the top edges of the gear box side walls 26 and 27 and end walls 29 by a suitable adhesive or other fastening means.

A one-piece plastic molded mount 41 for a shift lever and motor is supported by the cover 35 for reciprocating, front-to-back, sliding movement relative to the cover. A U-shaped portion 43 of the mount 41 that is slightly narrower, and significantly shorter, than the opening 37 depends through the opening 37. The U-shaped portion 43 consists of a pair of spaced, substantially parallel and vertical, uprights 45 separated by the bottom bight portion 47, all of the same width. Each upright 45 has a bore 49. Extending laterally out each side from the top part of each upright 45 is a rib 51. The bottom of the rib 51*a* is formed with a depending knife edge 52. A longitudinally extending tab 53 also projects outwardly in the elongated direction from the top part of each upright 45. Spanning across the opening between the tops of the uprights is a pair of spaced parallel truss members 55, each having an aligned hole 56.

Figure 8:
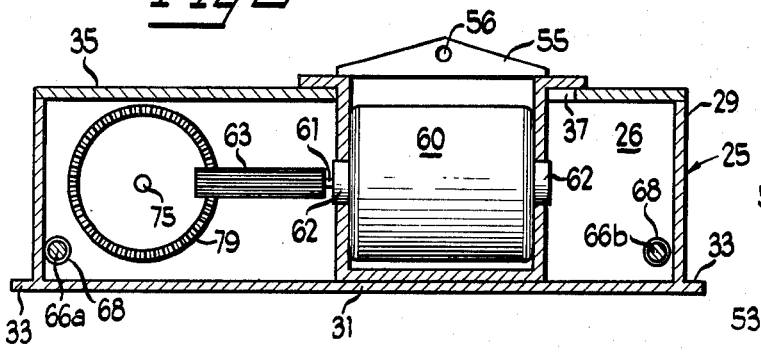
FIG. 8 is a cross-sectional view of the gear box taken substantially along line 8—8 of FIG. 6.
Figure 9:
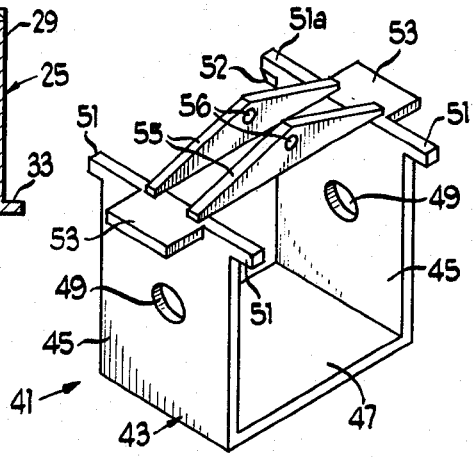
FIG. 9 is an enlarged perspective view of the shift lever-motor mount.

The length from the outside of one of the tabs 53 to the outside of the opposed upright 45 is greater than the length of the opening 37 in the cover 35. The dimension of the span from the end of the one rib 51 to the other rib on the same upright is also greater than the width of the opening 37. However, the length from the outside of the principal part of one upright 45 to the outside of the other upright 45 is significantly less than the length of the hole 37. Thus it will be appreciated that the greater portion of the U-shaped member from the ribs 51 and tabs 54 down will be disposed through the opening 37 and be supported on the cover for relative sliding movement in the longitudinal direction of the gear box 25. As is perhaps best shown in FIG. 8, the overall height of the mount 41 is such that the bottom of the bight portion 47 can rest on the floor 32 of the gear box 25, so that the entire weight of the shift lever motor mount 41 for the motor and shift lever is not borne entirely by the projecting ribs 51 and tabs 53. In the area along one side of the opening 37 and toward the forward end of the opening 37, the cover 35 is provided with a series of three spaced detents 57F, 57N and 57R. Depending upon the position of the mount 41 with respect to the length of the opening 37, the knife edge 52 of the rib 51*a* will sit in one of the detents to assist in positioning the mount for switching purposes.

A conventional DC electric motor 60 of suitable design having a shaft 61 in opposed axial end bushings 62 is seated in the mount 41 with each busing 62 received in a respective bore 49 in an upright 45. Long motor pinion 63 is fixed on the end of the shaft 61 that extends from the back end of the motor 60 as it is seated in the mount 41.

A pair of axles 66*a* and 66*b* are journaled for rotation through respective aligned front and aligned rear apertures 67 extending through the chassis sides 14 and 15. Each of the axles 66 also pass through respective openings 68 that extend through the sides 26 and 27 of the gear box. Each of the openings 68 may be of a somewhat larger diameter than that of the openings 67 to provide adequate clearance for movement of the gear box sides 26 and 27 along the axles 66. Coaxially mounted on each end of each of the axles 66 for rotation with the axle is a wheel 70 of conventional design. Each wheel 70 has a coaxial hub 71 that projects from one side of the wheel and spaces the wheel from the side of the chassis 13. The hub 71 may be integrally formed as part of the wheel or may comprise a separate piece onto which a tire or the like is fitted.

On the rear axle 66*a*, between the wheel 70 and the side 14 of the chassis, a wheel drive gear 73*a* is secured to the hub 71 and through the hub 71 is in driving engagement with the axle 66*a*. Similar wheel drive gears 73*b* and 73*c* are secured to the hub 71 between the wheel 70 and the chassis side 15 on the rear and front axles respectively.

Toward the rear of the gear box 25 a rear drive shaft 75 extends through aligned bores 76 and 77 in sides 26 and 27 respectively of the gear box. The shaft 75 is in spaced parallel relationship to the rear axle 66*a*. Mounted for rotation with the drive shaft 75 is a crown gear 79 with successively stepped down hub portions forming spacer 80, bearing 81, and pinion 82. Bearing portion 81 is journaled for rotation in bore 76 in the side 26 of the gear box. The crown gear 79 is in constant driven engagement with the long motor pinion 63. At the other end, drive shaft 75 is journaled for rotation in as pur gear 84 having successively stepped down hub portions forming a spacer 85, a bushing portion 86, and a pinion 87. Bushing portion 86 is itself journaled for rotation in the bore 77 in the gear box side 27. Thus, both the spur gear 84 and the pinion 87 rotate within the bore 77 in the gear box as well as around, and independently of, the drive shaft 75. The pinions 82 and 87 are the same size.

Openings 89 and 90, of a size large enough for the respective pinions 82 and 87 as well as parts of the journaled portions 81 and 86 to pass through, are provided in side 14 and 15 respectively. The centers of the drive shaft 75 and the rear axle 66*a* are spaced a distance substantially equal to the sum of the pitch radii of the pinion and the wheel drive gear. When the gear box 25 is shifted in the axial direction of the axles 66 and drive shaft 76 along the slots 23, either pinion 82 may be moved into driving engagement through opening 89 in side 14 of the chassis with wheel drive gear 73*a* or pinion 87 may be moved through opening 90 into engagement with wheel drive gear 73*b*. Thus, when the gear box 25 is moved to the position shown in FIG. 5 the pinion 82 driven through the crown 79 at a first "high" speed is in driving engagement with the wheel drive gear 73*a*, causing only the rear axle and wheel assembly to revolve at the high two-wheel drive rate of speed.

Another crown gear 92 is secured, by means of a splined shaft or press fit, for rotation on shaft 93 which is journaled for rotation in the side wall 27 and the intermediate support wall 28 of the gear box 25. Crown gear 92, like crown gear 79, is in constant driven engagement with the long motor pinion 63. Also secured to the shaft 93 for rotation with the shaft 93 is an integral coaxial spur gear 95 and pinion 96. Spur gear 95 engages an intermediate idler gear 98 secured on shaft 99 for rotation with the shaft which is journaled between the walls 27 and 28. Idler gear 98 in turn engages another combination spur 101 and pinion 102 that is secured for rotation on shaft 103 journaled between walls 27 and 28. Pinion 102 engages spur gear 105 that has integrally formed successive stepped down hub portions forming spacer 107, bearing 108, and pinion 109 which is the same size as pinions 82 and 87. The bearing portion 108 is journaled for rotation in bore 111 in the wall 27 of the gear box.

Figure 4:
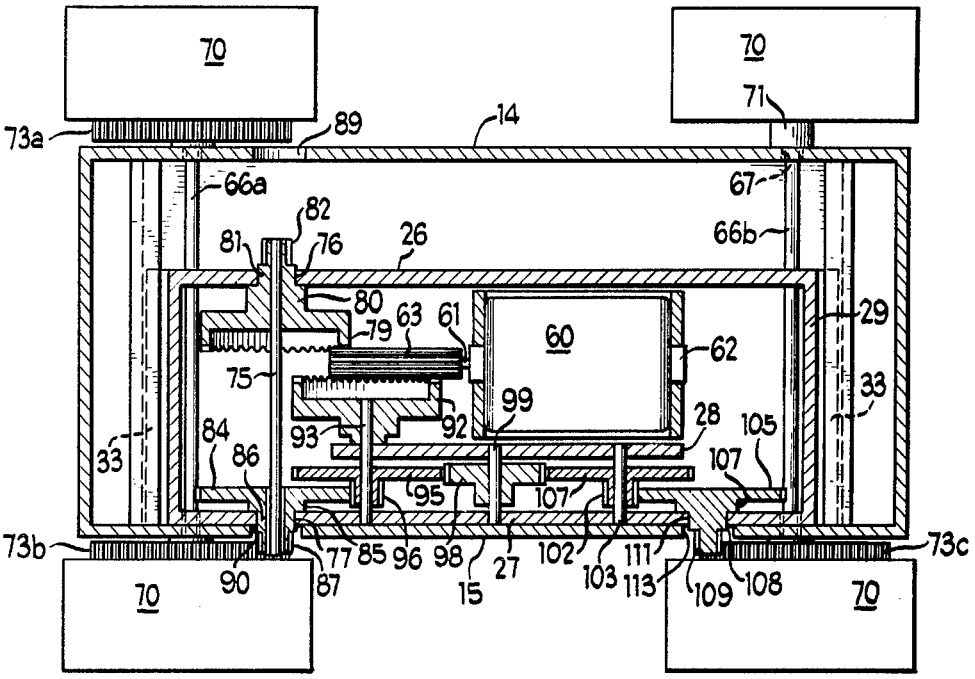
FIG. 4 is a sectional view taken substantially along line 4—4 of FIG. 2.

An opening 113, similar in size to openings 89 and 90, is provided in the wall 15 of the chassis adjacent wheel drive gear 73*c* to permit the pinion 109 and a part of the bearing portion 108 to project through the chassis upon shifting the gear box into contact with the inside of chassis wall 15 as shown in FIG. 4. When pinion 109 projects through opening 113 it will engage wheel drive gear 73*c*. Pinion 96 engages the spur gear 84 to rotate the pinion 87 which can be moved to project through opening 90 in chassis side wall 14 adjacent rear wheel drive gear 73*b*. In the center, between the positions illustrated in FIGS. 4 and 5, none of the pinions 82, 87, or 113 will be engaging any of the wheel drive gears 73 and the vheicle will be in neutral.

The two crown gears 79 and 92 are the same size, and the spur gear 84 is approximately the same diameter as the crown gears. However, the ratio of the pinion 96 to the spur gear 84 is approximately 1 to 4. Thus it will be appreciated that the pinion 82, driven directly through the crown gear 79, rotates at a speed about four times faster than the pinion 87 which is driven through the speed reducing gear train comprising crown gear 92 and coaxial smaller pinion 96 engaging spur gear 84. The coaxial spur 84 and pinion 87 are the same as coaxial spur 105 and pinion 109. In addition, combination spur 95 and pinion 96 and combination spur 101 and pinion 102 are identical. Since idler gear 98 has no effect on the speed but only serves to reverse the rotational direction, both pinions 87 and 109 rotate at the same rate of speed. Accordingly, when the gear box 25 is moved to the position shown in FIG. 4, the pinions 87 and 109 will engage the wheel drive gears **73*b* and 73*c*** respectively, resulting in all four wheels being driven at the second "low" speed.

Figure 5:
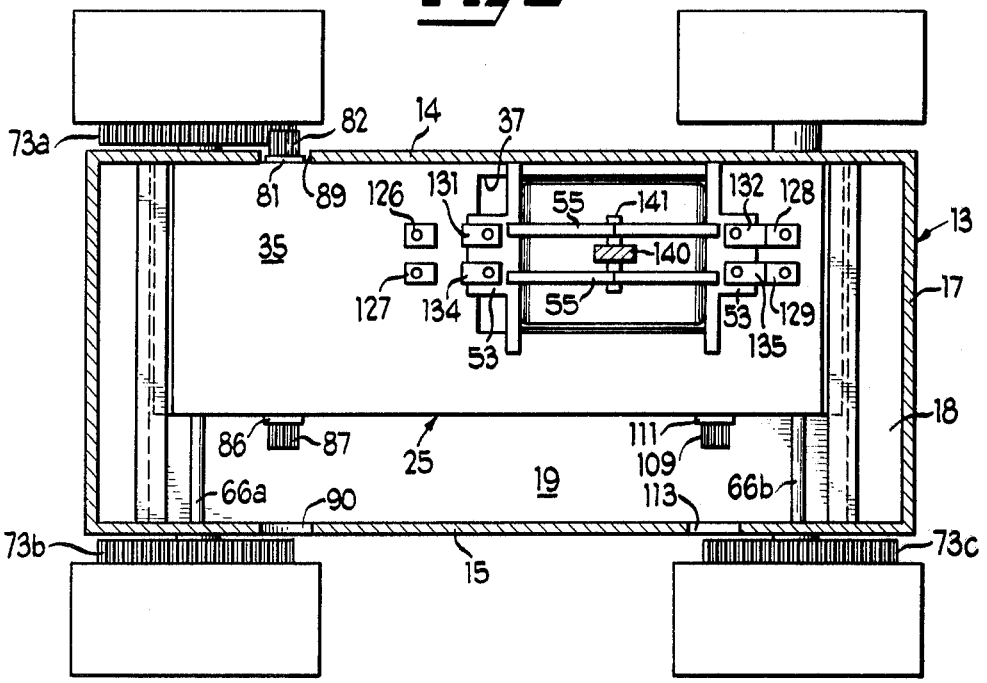
FIG. 5 is a sectional view taken substantially along line 5—5 of FIG. 2 but showing the vehicle in reverse high two-wheel drive.
Figure 6:
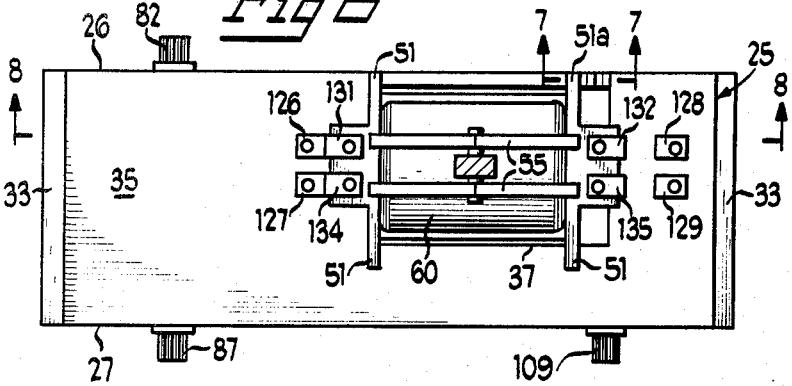
FIG. 6 is a view taken substantially along the same line 5—5 of FIG. 2 but showing only the gear box in the forward drive position.
Figure 7:
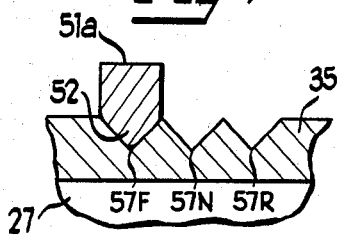
FIG. 7 is an enlarged partial sectional view taken substantially along line 7—7 of FIG. 6.
Figure 10:
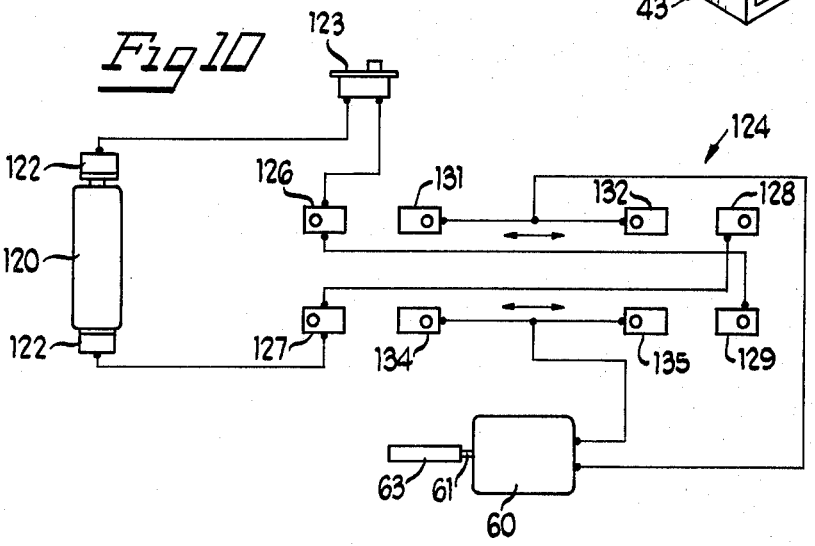
FIG. 10 is a schematic wiring diagram.

DC electric motor 60 is connected to a battery 120 retained in a clip 121 on the body 12. The battery is connected through contacts 122, an overriding conventional on/off switch 123 and a reversing switch 124 to the motor as indicated in the schematic wiring diagram of FIG. 10. One pole of the battery 120 is connected to the on/off switch 123 which is in turn connected to a fixed forward drive contact 126. The other pole of the battery 120 is connected to another fixed forward drive contact 127 which is in turn electrically connected to fixed rear drive contact 128. The fixed forward contact 126 is electrically connected to fixed rear drive contact 129. The rotor of the motor 60 is connected to both movable forward drive contact 131 and movable rear drive contact 132 while the stator is connected to both movable forward drive contact 134 and movable rear drive contact 135. As is shown in FIGS. 5 and 6, the fixed forward drive contacts 126 and 127 as well as the fixed reverse drive contacts 128 and 129 are secured on the gear box cover 35 to the rear and to the front of the opening 37 respectively. The forward movable contacts 131 and 134 are mounted on one tab 53 of the mount 41 while the movable rear contacts 132 and 135 are mounted on the other tab 53. Thus, when the mount 41 is moved toward the back of the vehicle to the position shown in FIG. 6, the battery 120 is connected through the on/off switch 123 and the forward drive contacts 126, 127, 131, and 134 to rotate the motor shaft 61 and long motor pinion 63 in one direction and drive the vehicle forward. However, when the mount 41 is shifted toward the front of the vehicle to the position shown in FIG. 5, the polarity of the battery voltage is reversed and through the on/off switch 123, the fixed forward drive contacts 126 and 127, the cross-over connection to fixed reverse drive contacts 128 and 129, and through the movable reverse drive contacts 132 and 135 to rotate the motor 61 and the long motor pinion 63 in the opposite direction and drive the vehicle in reverse. Between the forward and reverse drive connections, the electric connection will be broken and the power to the motor will be cut off in the central neutral position. Pinion 63 is long enough to remain in the driving engagement with both crown gears 79 and 92 during the reciprocal shifting of the motor 60 and mount 41.

In order to effect the front-to-back shifting of the mount 41 to change between forward and reverse as well as to shift the gear box 25 from side-to-side to switch between two-wheel and four-wheel drive, one end of a shift lever 140 is secured to the trusses 55 by means of a fastener 141 extending through the holes 56 in the trusses. An opening 142 in the shape of an "H" shift pattern is provided in the roof of the vehicle body 12 controlling the movement of the lever 140 into the proper position for selecting any one of: neutral; low four-wheel drive forward; low four-wheel drive reverse; high two-wheel drive forward; or high two-wheel drive reverse. A suitable shift knob 143, which may be provided with indicia of the pattern, is affixed to the free end of the shift lever 140 to facilitate manipulating the lever through the shift pattern. In operation, a child will usually hold the vehicle 11 with one hand while grasping the knob 143 with the other hand. Thus, the motion of the wheels in one mode will be stopped by the weight exerted by the one hand before the vehicle is shifted into another mode and released.

While there has been illustrated and described a particular embodiment of the present invention, it will be apparent that various changes and modifications will occur to those skilled in the art. It is intended in the appended claims to cover all such changes and modifications as fall within the true spirit and scope of the present invention.

What is claimed as new and desired to be secured by Letters Patent is:

1. A motor driven toy wheeled vehicle comprising:
a body;
a chassis to which the body is attached;
a rear axle and wheel assembly supported for rotation by the chassis;
a front axle and wheel assembly supported for rotation by the chassis;
a motor carried by the chassis;
first transmission means for driving engagement between the motor and one axle and wheel assembly;
second transmission means for driving engagement between the motor and both the rear and front axle and wheel assemblies;
a gear box carried by the chassis for movement relative to the chassis;
the first and second transmission means being supported by the gear box; and
shift means for moving the gear box to selectively engage either the first or second transmission means in its said driving engagement.

2. The toy of claim 1 in which the second transmission means includes speed reduction gearing to drive the two axles at a speed slower than the first transmission means drives the one axle.

3. The toy of claim 1 in which:
the motor is supported by the gear box;
both the first and second transmission means are in constant driven engagement with the motor;
the first transmission means is drivingly engagable with a first wheel gear attached to one axle;
the second transmission means is drivingly engagable with second and third wheel gears attached to the rear and front axles respectively; and
the motor, first transmission means, and second transmission means are movable with the gear box to selectively engage the first wheel gear or the second and third wheel gears.

4. The toy of claim 3 in which the second transmission means includes speed reduction gearing to drive the two axles at a speed slower than the first transmission means drives the one axle.

5. The toy of claim 4 in which:
the motor is a DC electric motor reversible upon change in the polarity of the power source;
a switch means is carried by the gear box;

the switch means is movable from a first position in which the motor is connected to the DC power source to drive the motor in a forward direction to a second position in which the polarity of the DC power source to the motor is reversed and the motor is driven in the opposite direction; and the shift means is connected to the switch means to move the switch means between the first and second positions.

6. The toy of claim 5 in which:

a mount for the motor and shift means is supported by the gear box for movement relative to the gear box;

the mount is movable in a direction transverse to the direction in which the gear box is movable relative to the chassis; and the switch means includes fixed contacts attached to the gear box and movable contacts attached to the mount.

7. The toy of claim 4 in which:

the chassis is elongated in the direction transverse to the axles; and the gear box is carried for slidable movement in a direction parallel to the axles.

8. The toy of claim 7 in which:

the motor is a DC electric motor reversible upon change in the polarity of the power source;

a switch means is carried by the gear box;

the switch means is movable from a first position in which the motor is connected to the DC power source to drive the motor in a forward direction to a second position in which the polarity of the DC power source to the motor is reversed and the motor is driven in the opposite direction; and the shift means is connected to the switch means to move the switch means between the first and second positions.

9. The toy of claim 8 in which the switch means is movable to a third position in which no connection is made between the motor and the power source.

10. The toy of claim 8 in which:

a mount for the motor and shift means is supported by the gear box for movement relative to the gear box;

the mount is movable in a direction transverse to the direction in which the gear box is movable relative to the chassis; and the switch means includes fixed contacts attached to the gear box and movable contacts attached to the mount.

11. The toy of claim 1 in which:

the motor is a DC electric motor reversible upon change in the polarity of the power source;

a switch means is carried by the gear box;

the switch means is movable from a first position in which the motor is connected to the DC power source to drive the motor in a forward direction to a second position in which the polarity of the DC power source to the motor is reversed and the motor is driven in the opposite direction; and the shift means is connected to the switch means to move the switch means between the first and second positions.

12. The toy of claim 11 in which the switch means is movable to a third position in which no electrical connection is made between the motor and the power source.

13. The toy of claim 11 in which:

a mount for the motor and shift means is supported by the gear box for movement relative to the gear box;

the mount is movable in a direction transverse to the direction in which the gear box is movable relative to the chassis; and the switch means includes fixed contacts attached to the gear box and movable contacts attached to the mount.

14. The toy of claim 13 in which the second transmission means includes speed reduction gearing to drive the two axles at a speed slower than the first transmission means drives the one axle.

15. The toy of claim 1 in which:

the motor is selectively drivable in one of two direction;

a DC power source for the motor is carried by the vehicle;

the direction of the motor is determined by the polarity of the connection to the DC power source;

a switch is disposed between the motor and the DC power source;

the switch is movable among a forward drive position in which the motor and the DC power source are connected in a first polarity, a reverse drive position in which the motor and the DC power source are connected in an opposite polarity and an intermediate position in which no electrical connection is effected between the DC power source and the motor; and the reversing switch is carried by the gear box and connected to the shift means for selectively moving the switch among the three positions.

16. The toy of claim 1 in which the shift means comprises:

a shift lever having one end connected to the gear box;

the free other end of the shift lever extends through the vehicle body; and manipulation of the free end effects movement of the gear box to selectively engage either the first or the second transmission means.

17. The toy of claim 16 in which:

the body is provided with a shift pattern opening; and the free end of the shift lever extends through the opening whereby the movement of the shift lever is controlled by the pattern opening.

18. A motor driven toy wheeled vehicle including:

a chassis;

front and rear axle and wheel assemblies journaled for rotation in the chassis;

a DC electric motor carried by the chassis;

a gear box carried by the chassis for movement relative to the chassis;

the motor being disposed within the gear box;

first gear means for drivingly connecting the motor to one of the axle and wheel assemblies at a first speed;

second gear means supported by the gear box for drivingly engaging the motor with both the front and rear axle and wheel assemblies;

the second gear means including speed reducing means for driving the front and rear axle and wheel assemblies at a second speed;

a DC power source for the motor carried by the vehicle;

switch means supported by the gear box for reversing the polarity between the DC power source and the motor to effect reversal of the motor; and a shift lever to control both the reversing switch and the means for selectively engaging either the first or second gear means to drive the vehicle.

19. The toy of claim 18 in which:

a mount for the motor and shift lever is supported by the gear box for movement relative to the gear box in a direction transverse to the direction in which the gear box is movable relative to the chassis;

the mount bears the motor within the gear box;

one end of the shift lever is connected to the mount;

the free other end of the shift lever is manipulable to effect movement of the gear box in the one direction and the mount in the transverse direction; and fixed contacts for the switch means are attached to the gear box and movable contacts for the switch means are attached to the mount.

20. The toy of claim 19 in which:

a body is attached to the chassis;

the body is provided with a shift pattern opening; and the free end of the shift lever extends through the opening whereby the movement of the shift lever is controlled by the pattern opening.

* * * * *